US006432597B1

(12) United States Patent
Haggquist et al.

(10) Patent No.: US 6,432,597 B1
(45) Date of Patent: Aug. 13, 2002

(54) ELECTROPHOTOGRAPHIC PHOTOCONDUCTOR CONTAINING FLUORENYL-AZINE DERIVATIVES AND TRIARYLAMINE IN TRANSPORT LAYER

(75) Inventors: Gregory Walter Haggquist, Longmont; Ronald Harold Levin, Boulder; Weimei Luo, Louisville; Scott Thomas Mosier, Boulder, all of CO (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/732,824

(22) Filed: Dec. 8, 2000

(51) Int. Cl.[7] ..... G03G 5/047

(52) U.S. Cl. ..... 430/58.45; 430/58.65; 430/58.8; 430/56; 430/970

(58) Field of Search ..... 430/58.45, 58.65, 430/58.8, 970, 56

(56) References Cited

U.S. PATENT DOCUMENTS 4,362,798 A 12/1982 Anderson et al.
4,415,640 A * 11/1983 Goto et al. ..... 430/58.45
4,563,408 A * 1/1986 Lin et al. ..... 430/58.8
4,784,929 A 11/1988 Ueda
5,494,766 A * 2/1996 Dohi et al. ..... 430/58.8
5,952,142 A 9/1999 Derks et al.
6,004,708 A 12/1999 Bellino et al.

FOREIGN PATENT DOCUMENTS

DE 37 16982 A1 11/1987
JP 61209456 9/1986
JP 62 006262 1/1987

OTHER PUBLICATIONS

Borsenberger, Paul M. et al. Organic Photoreceptors for Imaging Systems. New York: Marcel–Dekker, Inc. pp. 181–183, 190–195, 202–217. (1993).*

* cited by examiner

*Primary Examiner*—Christopher Rodee
(74) *Attorney, Agent, or Firm*—John A. Brady

(57) ABSTRACT

Azine derivatives or their combinations with hindered phenol antioxidant in the charge transport layer containing one or more triarylamines or a combination of one triarylamine and one hydrazone improve light fatigue of a photoreceptor, which results in stabilized print quality. The robust performance against light damage allows the shutter in a cartridge to be removed and the requirement for special protection procedure during inspection and handling to be simplified.

20 Claims, No Drawings

ELECTROPHOTOGRAPHIC PHOTOCONDUCTOR CONTAINING FLUORENYL-AZINE DERIVATIVES AND TRIARYLAMINE IN TRANSPORT LAYER

TECHNICAL FIELD

The present invention relates to an improved photoconductor used in electrophotographic reproduction devices, having a charge generating layer and a charge transport layer, which exhibits reduced room light and cycling fatigue and potentially improved sensitivity of the photoconductor.

BACKGROUND OF THE INVENTION

Azines, which are the products of condensing remaining $NH_2$ of a hydrazone with a carbonyl compound, have been reported for electrophotographic applications, both as a transport molecule and a dopant in hydrazone-containing charge transport layers (U.S. Pat. No. 6,004,708, commonly assigned with this application). T. Ueda et al. from Minolta Camera Company (DE 3716982, JP 62006262, JP 61209456) claims several series of hydrazones and azines as charge transporting materials. Some other examples can be found in JP 61043752, JP 61043753 and JP 61043754.

The azine compounds used in this invention which are derivatives of fluorene, when used as charge transport molecules do not exhibit good injection into charge generation molecule due to their high oxidation potentials. The highlight of this invention is that these derivatives can be used as an efficient light filter and/or excited state quencher for charge transport formulations, which results in significant reduction in room-light fatigue and cycling fatigue. As a result, print defects caused by positive or negative fatigue are significantly reduced.

A good photoconductor should have stable electrostatic characteristics and robust mechanical properties under severe conditions, e.g. light exposure and touch by human hands during handling and storing. However, fatigue induced by light exposure is still quite common in present-day products. This fatigue can be so severe that some charge transport formulations containing hydrazone compounds results in the increase of photodischarge by several hundred volts if no light absorber is used. It has been found that photoisomerization and photochemical reactions are mostly responsible for fatigue. For example, p-(diethylamino) benzaldehyde diphenylhydrazone (DEH) undergoes a photochemically induced unimolecular rearrangement to an indazole derivative, 1-phenyl-3-(4(diethylamino)-1-phenyl)-1,2-indazole. Excellent review of mechanism of photoinduced fatigue can be found from the following articles: J. Pacansky, et al.; *Chem. Mater.* 1992, 4 401; T. Nakazawa, et al.; *Chem. Lett.* 1992, 1125; E. Matsuda, et al.; *Chem. Lett.* 1992, 1129. Thus, it is important to find an effective light absorber for a charge transport material to filter away the harmful wavelength light. An example can be found in H. W. Anderson and B. Champ, U.S. Pat. No. 4,362,798, in which Acetosol Yellow was added to formulation of p-(diethylamino) benzaldehyde diphenylhydrazone (DEH). Most recently, the foregoing commonly assigned U.S. Pat. No. 6,004,708 was issued to M. Bellino, B. Champ and W. Luo, which claims using azine derivatives to reduce fatigue of DEH charge transport properties.

Fluorenyl azines described in this disclosure are known compounds (structure see Scheme 1). For example, 9-[p-(diethylamino)benzylidenehydrazono]fluorene has been disclosed in JP 57138644 and JP 59195659 as a charge transport material, however, no work has been done to use these azine derivatives with triarylamine molecules, e.g. N, N'-diphenyl-N,N'-di(m-tolyl)-p-benzidine (TPD), to mitigate light fatigue.

SUMMARY OF THE INVENTION

This disclosure pertains to significant improvement of electrostatic stability of a photoconductor by formulating an azine derivative and an antioxidant into charge transport formulations containing at least one triarylamine or a combination of a tariarylamine and a hydrazone. Very low percentage of azine, even as low as 0.5%, is efficient to stabilize both sensitivity and dark decay. Particularly when a combination of azine and antioxidant is used, additional advantage of reduced dark decay and improved crazing resistance has been seen.

The structures of the azine and charge transport compounds used in this invention are shown in Scheme 1 and 2.

Scheme1
Structure of Azine Derivatives

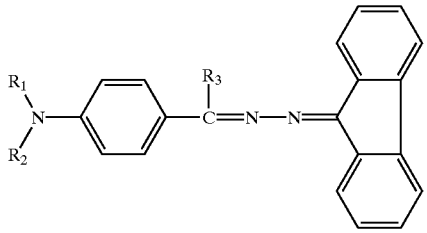

Where $R_1$ and $R_2$=ethyl, phenyl; $R_3$=hydrogen, phenyl.

Scheme 2
Charge Transport Molecules

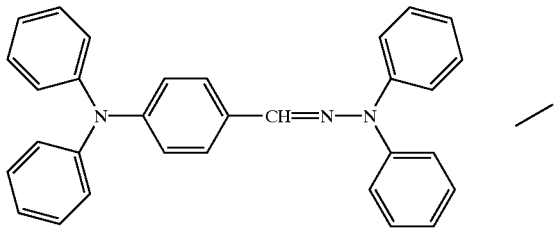

TPH

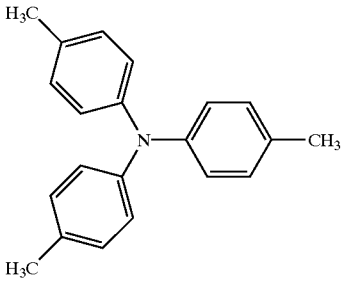

TTA

-continued

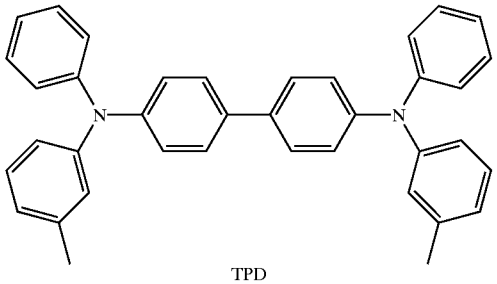

TPD

Addition of azine compounds at about 0.5–about 5% by weight in a charge transport layer having triarylamine, binder and other materials making up the remaining 95–99.5 weight stabilizes electrostatic characteristics of a photoconductor upon exposure to light. As a result, print defects from light fatigue are reduced or eliminated. Moreover, a combination of antioxidant and azine improves both initial electrical properties and fatigue induced by electrical cycling or room light exposure.

DETAILED DESCRIPTION OF THE INVENTION

The charge transport molecules were selected from triarylamines, or combinations of triarylamines and hydrazones. Several examples are tri-p-tolylamine (TTA), N,N'-diphenyl-N,N'-di(m-tolyl)-p-benzidine (TPD) and p-diphenylaminobenzaldehyde diphenylhydrazone (TPH).

The photoconductor consists of a conductive substrate, which is anodized and sealed aluminum core, a charge generation layer and a charge transport layer. The charge generation layer typically is comprised of a pigment, which is dispersed evenly in one or more type of binders before coating. The charge transport layer is comprised of one or more charge transport molecules and binder, with and without additives.

Two test methods described below were used to evaluate each formulation with and without these additives: parametric measurement and multiple wavelength exposure.

Parametric Measurement:

The electrical charge, discharge, and dark decay characteristics are determined initially for each PC drum. The drums are then exposed to a cool white fluorescent bulb (0.231 mW/cm$^2$) for 20 minutes (0.35 J/cm$^2$) while being rotated to achieve uniform exposure. Subsequently, the drums are retested to determine the electrical changes caused by the light exposure. This method is used to simulate exposure within an office environment. Change before and after light exposure in residual voltage (ΔV@E=0.80) and dark decay (ΔDD) are summarized in Table 1.

Multiple Wavelength Exposure:

PC drums were irradiated with 390 nm to 600 nm light for 15 minutes. A Jarrel Ash 1200 groove/mm ruled grating blazed at 300 nm was used to disperse the white light from a 150 W Xe arc lamp (Oriel). The PC drum was contained in a Lexmark Optra T printer cartridge, the shutter was held open and the drum was positioned such that the dispersed light is irradiated across the drum. Calibration marks were inscribed on the drum so as to have reference marks on the print samples. A fiber optic connected to an Acton SP 150 spectrograph with a Princeton Instrument photodiode array detector was used to determine the peak wavelength at each of the reference points. The PC drum was irradiated for 15 minutes and then immediately after irradiation printed on a Lexmark Optra T 616 laser printer. A print quality pack was collected initially, and after 500, 1000, 1500, 2000 and 4000 printed pages of 5% coverage. Prints were evaluated for print darkening and print lightening. The print image from the drum with and without azine in the charge transport layer indicates that addition of azine to the charge transport formulation stabilizes print quality for both TPD and TPH/TTA.

Photoconductor drums containing TPD show darker print when exposed to room light. The positive fatigue can be seen when measuring electrical from a parametric tester. The positive fatigue is a result of an increase in the discharge Table 1 shows the TPD sample without any additives has 30 volt charge at residual and an increase in the dark decay 166 V/S. Adding an azine to the charge transport layer substantially reduces the amount of charge. The residual discharge voltage changes by an average of 20 V and the amount of increased dark decay is reduced to less than 20 V/second. Meanwhile, a known room light fatigue agent used in Lexmark photoconductor, Acetosol Yellow, reduces fatigue as well, but not as effectively as azine. The following print data shows the effect even more. The print without the azine additive shows a darker print in the area where the drum was irradiated with 350–500 nm light, whereas, the print from the sample with the azine additive shows no apparent darkening. Further, examination of the TPH/TTA prints shows a lighting of the printed image when no additive is used after irradiation with 350–500 nm light and no change when the azine additive is present.

TABLE 1

Light Fatigue of Photoconductor by Parametric Measurement: 40% TPD in Charge Transport Layer

| Irganox 1076, % | Azine, % | Acetosol Yellow, % | ΔV @ E = 0.8 μJ/cm$^2$ | ΔDD @ 0.1 sec | ΔDD @ 1 sec |
|---|---|---|---|---|---|
| 0 | 0 | 0 | 30 | 21 | 166 |
| 0 | 0 | 2 | 45 | 7 | 57 |
| 0 | 2 | 0 | 14 | 1 | 13 |
| 0 | 2 | 2 | 24 | 2 | 17 |
| 4 | 0 | 0 | 58 | 8 | 70 |
| 4 | 0 | 2 | 59 | 3 | 27 |
| 4 | 2 | 0 | 16 | 1.2 | 11 |
| 4 | 2 | 2 | 27 | 0.9 | 26 |

The percentage of antioxidant and azine were also explored to find the optimum point. An example can be seen from Table 2. The smallest change can be seen with adding 1% azine to the charge transport layer. IRGANOX 1076, the antioxidant is a hindered phenol.

TABLE 2

Effect of Concentration of Antioxidant and Azine on Light Fatigue of Photoconductor by Parametric Measurement

| Irganox 1076, % | Azine, % | ΔV @ E = 0.8 μJ/cm$^2$ | ΔDD @ 0.1 sec | ΔDD @ 1 sec |
|---|---|---|---|---|
| 4 | 2 | 20 | 0.2 | 1.8 |
| 2 | 1 | 16 | 0.7 | 6.8 |
| 1 | 0.5 | 24 | 1.2 | 12 |

Charge Generation Layer:

CG dispersion consists of titanyl phthalocyanine and polyvinylbutyral (BX-55Z, Sekisui Chemical Co.) in a ratio of 45/55 in a mixture of 2-butanone and cyclohexanone. The CG dispersion was dip-coated on aluminum substrate and dried at 100° C. for 15 minutes to give a thickness less than 1 μm, and more preferably, 0.2–0.3 μm.

Charge Transport Layer:

A charge transport formulation containing 40% TPD was prepared by dissolving TPD and polycarbonate A (Makron 5208, Bayer Inc.) in a mixed solvent of tetrahydrofuran and 1 ,4-dioxane. Charge transport layer was coated on top of charge generation layer and cured at 120° C. for 1 hour to give a thickness of 20–27 $\mu$m. A charge transport formulation containing 40% of TPH/TTA(30/10) was prepared in the same way as mentioned above except replacing TPD with TPH/TTA. Similarly, charge transport solution with additives was prepared by replacing polymer with a certain percentage of azine, antioxidant or their combination.

What is claimed is:

1. An electrophotographic imaging member comprising a charge generation material and a charge transport layer comprised of TTA or TPD as a charge transport molecule, a polymeric binder, and a fluorenyl-azine additive having the formula:

Scheme1
Structure of Azine Derivatives

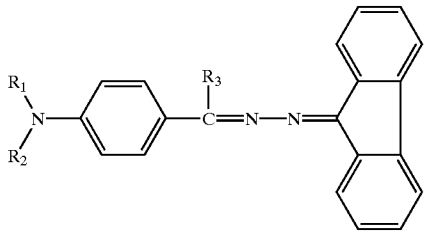

wherein $R_1$ and $R_2$ are independently selected from the group consisting of ethyl and phenyl and $R_3$ is selected from the group consisting of hydrogen and phenyl.

2. The imaging member as in claim 1 also comprising a hindered phenol antioxidant.

3. The imaging member as in claim 2 in which said triphenylamine comprises TDP.

4. The imaging member as in claim 3 in which said additive is in the amount of about 0.5 to about 5% by weight of the weight of said charge transport layer.

5. The imaging member as in claim 2 in which said triphenylamine comprises TTA.

6. The imaging member as in claim 5 in which said additive is in the amount of about 0.5 to about 5% by weight of the weight of said charge transport layer.

7. The imaging member as in claim 2 in which said additive is in the amount of about 0.5 to about 5% by weight of the weight of said charge transport layer.

8. The imaging member as in claim 1 in which said triphenylamine comprises TPD.

9. The imaging member as in claim 8 in which said additive is in the amount of about 0.5 to about 5% by weight of the weight of said charge transport layer.

10. The imaging member as in claim 1 in which said triphenylamine comprises TTA.

11. The imaging member as in claim 10 in which said additive is in the amount of about 0.5 to about 5% by weight of the weight of said charge transport layer.

12. The imaging member as in claim 1 in which said additive is in the amount of about 0.5 to about 5% by weight of the weight of said charge transport layer.

13. An electrophotographic imaging member comprising a charge generation material and a charge transport layer comprised of TPD as a charge transport molecule, TPH as a charge transport molecule, a polymeric binder, and a fluorenyl-azine additive having the formula:

Scheme1
Structure of Azine Derivatives

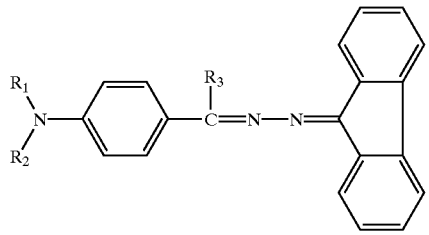

wherein $R_1$ and $R_2$ are independently selected from the group consisting of ethyl and phenyl and $R_3$ is selected from the group consisting of hydrogen and phenyl.

14. The imaging member as in claim 13 also comprising a hindered phenol antioxidant.

15. The imaging member as in claim 14 in which the additive is in the amount of about 0.5 to about 5% by weight of the weight of said charge transport layer.

16. The imaging member as in claim 13 in which the additive is in the amount of about 0.5 to about 5% by weight of the weight of said charge transport layer.

17. The electrophotographic imaging member comprising a charge generation material and a charge transport layer comprised of TTA as a charge transport molecule, TPH as a charge transport molecule, a polymeric binder, and a fluorenyl-azine additive having the formula:

Scheme1
Structure of Azine Derivatives

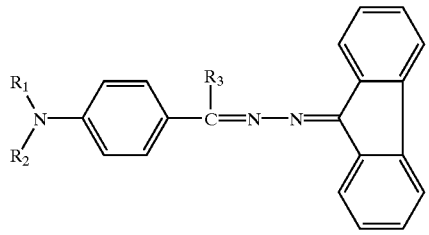

wherein $R_1$ and $R_2$ are independently selected from the group consisting of ethyl and phenyl and $R_3$ is selected from the group consisting of hydrogen and phenyl.

18. The imaging member as in claim 17 also comprising a hindered phenol antioxidant.

19. The imaging member as in claim 18 in which the additive is in the amount of about 0.5 to about 5% by weight of the weight of said charge transport layer.

20. The imaging member as in claim 17 in which the additive is in the amount of about 0.5 to about 5% by weight of the weight of said charger control layer.

* * * * *